United States Patent [19]

Beele

[11] 4,447,046

[45] May 8, 1984

[54] APPARATUS FOR ADDING STRONGLY REACTING MATERIALS INTO A MELT

[75] Inventor: Günther Beele, Kerpen-Blatzheim, Fed. Rep. of Germany

[73] Assignee: Klöckner-Humboldt-Deutz AG, Cologne, Fed. Rep. of Germany

[21] Appl. No.: 269,857

[22] Filed: Jun. 3, 1981

[30] Foreign Application Priority Data

Jun. 10, 1980 [DE] Fed. Rep. of Germany ..... 3021707

[51] Int. Cl.[3] ..... F27D 3/10; C21C 1/10

[52] U.S. Cl. ..... 266/216; 75/130 B

[58] Field of Search ..... 266/216; 75/130 B

[56] References Cited

FOREIGN PATENT DOCUMENTS 1410157 10/1975 United Kingdom ..... 75/130 B

*Primary Examiner*—M. J. Andrews

*Attorney, Agent, or Firm*—Watson, Cole, Grindle & Watson

[57] ABSTRACT

The lowermost end of a filling tube which extends through a protective top into a vessel containing a melt includes a support flange which mounts a dip container inside the vessel. The dip container is shaped to define an internal reaction chamber below the lowermost end of the filling tube and to provide communication between the internal reaction chamber and the melt. It includes a basket-shaped metal container which is attached to the support flange and an outer sheath formed of a reinforcing material-containing refractory, the outer sheath covering both the metal container and the filling tube up to a point near the protective top so as to leave an expansion joint between it and each of the metal containers, the filling tube and the protective top.

5 Claims, 1 Drawing Figure

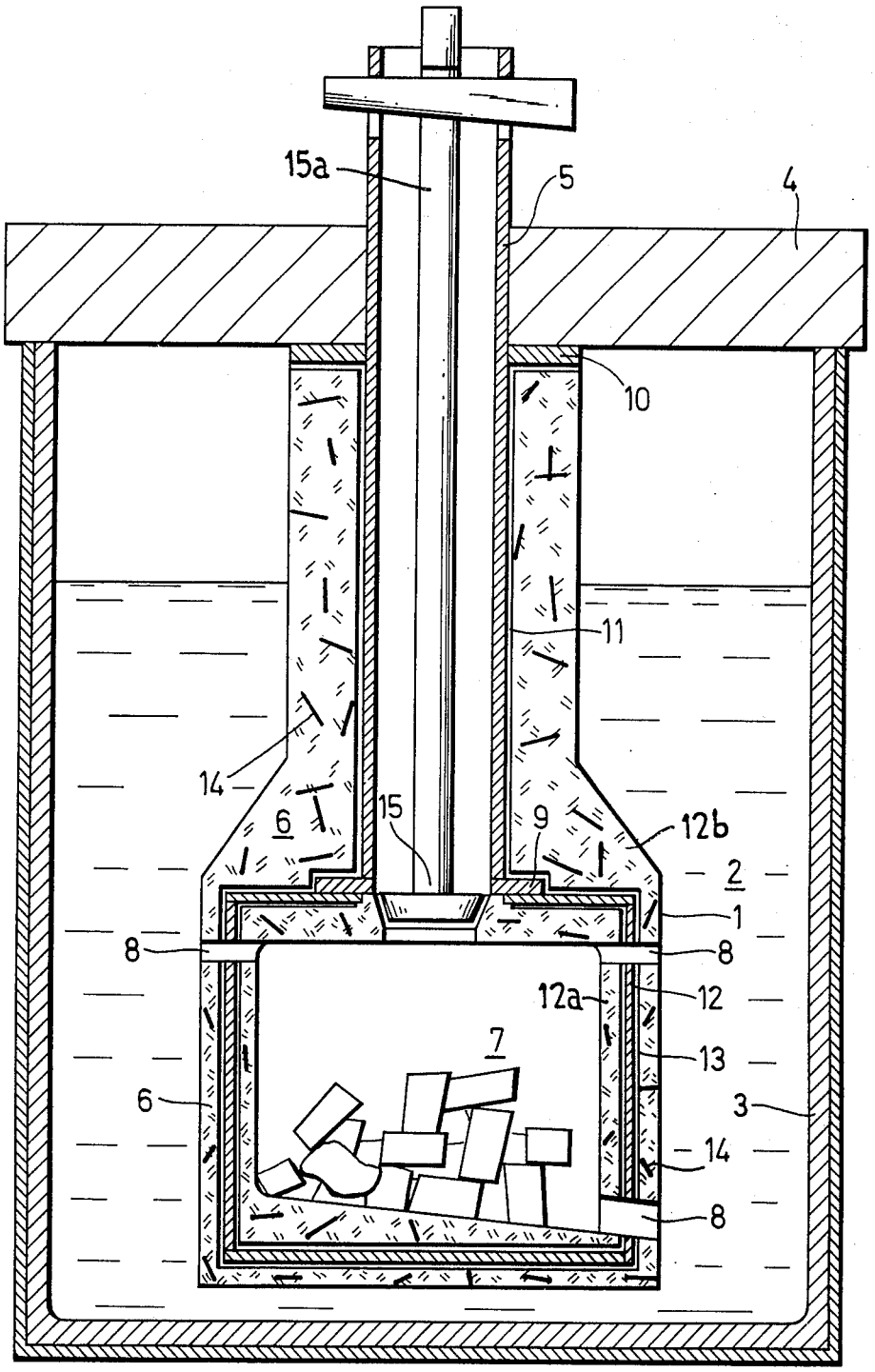
15a
5
4
10
11
14
6
15
9
12b
2
1
8
8
12a
12
7
13
6
3
14
8

APPARATUS FOR ADDING STRONGLY REACTING MATERIALS INTO A MELT

BACKGROUND OF THE INVENTION

1. Field of the Invention

The present invention relates to apparatus which can be used to add strongly reacting materials into a melt. 2. The Prior Art Structures which can be used to add strongly reacting materials such as magnesium into a melt such as an iron melt to form, for example, cast iron with spheroidal graphite, are known. For example, in German Publication No. 2 208 960 such a structure is shown which includes an open vessel in which the melt is contained, a protective top which covers the open top of the vessel, a filling tube which extends through the protective top into the inside of the vessel, and a dip container which is attached to the filling tube by a conically flaired end and which has an internal reaction chamber which is in communication with the melt in the vessel and is supplied with the strongly reacting materials by way of the filling tube. The dip container includes an outer portion which is composed of a refractory material and an inner portion in the form of a basket-shaped metal container, the basket-shaped metal container adding a certain stability to the dimensions of the internal reaction chamber.

However, the intense heating of the filling tube and the almost explosive reactions in the dip container which occur during the immersion process lead to the formation of cracks and often to the destruction of either the refractory material portion of the dip container or else the filling tube in the area of its attachment to the dip container. When this happens, the contents of the internal reaction chamber will pour into the melt during the immersion process, leading to an uncontrollable situation which can result in destruction of the processing vessel or the protective top. This in turn can lead to a molten metal overflow which, obviously, is hazardous for the equipment operators who are nearby. The cracks and equipment damage which occur during the immersion process occur primarily in the area of the sheathed filling tube, namely, at the location where the dip container is attached to the filling tube. However, it can also occur on the wall forming the reaction chamber.

It is an object of the present invention to provide an apparatus for adding strongly reacting materials to a melt which can withstand both the thermal stresses and the high vapor pressures resulting from the chemical reactions therein.

SUMMARY OF THE INVENTION

According to the present invention the refractory material used to form the dip container is stabilized by the employment of reinforcing materials dispersed therein and the dip container is attached to the filling tube so that the refractory portion will not be subjected to radial stresses as the filling tube expands. The dimensions of the elements used in the inventive apparatus are chosen so that an expansion joint is created between the dip container and each of the filling tube and the protective top.

In one particular embodiment of the invention the dip container will include a basket-shaped metal container within the refractory portion, the relative dimensions of the metal container and the outer refractory portion being such as to provide an expansion joint therebetween. Also, the reinforcing materials in the outer refractory portion can be austenitic high-grade steel pieces.

A further understanding of the present invention will be now achieved by referring to the accompanying FIGURE taken in conjunction with the following discussion, the FIGURE showing a cross-sectional side elevational view of an apparatus constructed in accordance with one embodiment of the present invention.

The inventive apparatus includes a vessel 3 which has an open upper end and which contains a melt 2, a protective top 4 which covers the open upper end of vessel 3, an elongated filling tube 5 which sealingly extends through an opening in the protective top 4 from a point outside the vessel 3 to a lowermost end within vessel 3, and a dip container 1 which is mounted on the filling tube 5 in vessel 3. The dip container 1 functions to introduce strongly reacting materials supplied thereto via filling tube 5 to the melt 2 in vessel 3.

It can be seen that the elongated filling tube 5 includes a fastening flange 10 which connects the filling tube to the lower surface of the protective cover 4, as well as a support flange 9 which extends outwardly of its lowermost end. A rod **15*a* is movable within the inner passageway of filling tube 5 to move a plug 15** to either open or close the lowermost end of the filling tube.

The dip container 1 includes a basket-shaped metal container 12 which is connected to the support flange 9 and helps form an internal reaction chamber 7 below the lowermost end of the filing tube 5, an inner lining **12*a* located along the inside of the metal container 12 and an outer sheath 12*b* which covers not only the outside of the metal container 12 but extends upwardly to surround the filling tube 5 up to a point just below the fastening flange 10. A number of passageways 8 extend through the inner lining 12*a*, the metal container 12 and the outer sheath 12*b* to allow for communication between the melt 2 in vessel 3 and the strongly reacting materials in reaction chamber 7**.

The inside dimensions of the outer sheath **12*b* are larger than the outside dimensions of either the metal container 12 or the filling tube 5 such that an expansion joint is formed therebetween. An expansion joint is also provided between the outer sheath 12*b* and the fastening flange 10. In addition, the outside dimensions of the inner lining 12*a* are smaller than the inside dimensions of the metal container 12** such that an expansion joint is formed therebetween as well.

The inner lining **12*a* and the outer sheath 12*b* of the plunger 1 are formed of refractory materials 6 which preferably include reinforcing materials 14** dispersed therein. Suitable reinforcing materials include fibrous materials or austenitic high-grade steel pieces.

Various modifications in the described invention can be made and still fall within the scope of the appended claims.

I claim:

1. An apparatus for adding strongly reacting materials to a melt which comprises a vessel for containing a metal melt, said vessel having an open upper end, a protective top covering the open upper end of said vessel, said protective covering including a hole therein, an elongated filling tube sealingly extending through said hole in said protective top from a location outside said vessel to a lowermost end inside said vessel and providing a material passageway therethrough, said filling tube including a support flange extending outwardly of the lowermost end, and a dip container mounted on said support flange of said filling tube, said dip container including an outer sheath which encloses an internal reactive chamber below the lowermost end of said filling tube and communicable with the passageway in said elongated filling tube, the outer sheath extending upwardly to surround said filling tube up to a point below said protective top, said outer sheath including at least one passageway therethrough to allow for communication between a melt in said vessel and the strongly reacting materials supplied thereto via said filling tube, said outer sheath having a larger inside dimension than the outside dimensions of said filling tube so as to provide a space therebetween as well as between the outer sheath and the protective top, which space functions as an expansion joint, and said outer sheath being formed of a refractory material having reinforcing materials dispersed therein.

2. The apparatus as defined in claim 1 wherein said dip container includes a metal container which is connected to said supporting flange and wherein said outer sheath covers the outside of said metal container, wherein said outer sheath has larger inside dimensions than the outside dimensions of said metal container to provide an expansion joint therebetween, and wherein said metal container has passageways therethrough which correspond with the passageways through said outer sheath.

3. The apparatus as defined in claim 2 wherein said dip container includes an inner lining located along the inside of said metal container, said inner lining having smaller outside dimensions than the inside dimensions of said metal container to provide an expansion joint therebetween, wherein said inner lining has passageways therethrough which correspond with the passageways through said metal container, and wherein said inner lining is formed of a refractory material having reinforcing materials dispersed therein.

4. The apparatus as defined in claim 1 wherein said reinforcing materials comprise austenitic high grade steel pieces.

5. The apparatus as defined in claim 1 including a rod which movably extends within said material passageway in said elongated filling tube from a location outside said vessel to an end adjacent said support flange, and a plug connected to the end of said rod adjacent said support flange which, based on the positioning of said rod along said elongated filling tube, is capable of closing off communication between said material passageway in said elongated filling tube and the internal reactive chamber in said dip container.

* * * * *